US005095506A

United States Patent [19]

Kikuno

[11] Patent Number: 5,095,506

[45] Date of Patent: Mar. 10, 1992

[54] SOUND REPRODUCTION SYSTEM UTILIZING SOUND EXTINCTION DEVICE

[76] Inventor: Kouichi Kikuno, 8-5 Betsusyo 1-Chome, Urawa-shi, Saitama, 336, Japan

[21] Appl. No.: 459,825

[22] PCT Filed: Jul. 22, 1987

[86] PCT No.: PCT/JP87/00533

§ 371 Date: Mar. 8, 1990

§ 102(e) Date: Mar. 8, 1990

[87] PCT Pub. No.: WO89/00800

PCT Pub. Date: Jan. 26, 1989

[51] Int. Cl.[5] ..... H04R 5/02; H04S 1/00

[52] U.S. Cl. ..... 381/1; 381/24

[58] Field of Search ..... 381/71, 1, 24

[56] References Cited

U.S. PATENT DOCUMENTS

| | | | |
|---|---|---|---|
| 2,983,790 | 5/1961 | Olson | 381/71 |
| 3,237,713 | 3/1966 | Leslie | 181/146 |
| 4,219,696 | 8/1980 | Kogure et al. | 381/1 |
| 4,712,247 | 12/1987 | Swarte | 381/59 |

FOREIGN PATENT DOCUMENTS

| | | | |
|---|---|---|---|
| 2550903 | 2/1985 | France | 381/71 |
| 48-54903 | 8/1973 | Japan . | |
| 50-13001 | 2/1975 | Japan . | |
| 51-32302 | 3/1976 | Japan . | |
| 52-103909 | 8/1977 | Japan . | |

*Primary Examiner*—Forester W. Isen
*Attorney, Agent, or Firm*—Larson & Taylor

[57] ABSTRACT

A silencer to be disposed near a listener (primarily his head, in a playback sound fiel. The silencer consists of a silencing member and a support member, and provides body sensing vibration similar to that of a real sound source by making variable the ratio of a sound pressure applied to the external auditory meatus to a sound pressure travelling to the body. The head reflection sound generated at the head of the listener is dampened by the silencing member disposed near the head (damping can be made irrespective of the difference in the head shape of an individual). Thus, the present invention can improve the transmission characteristics at the playback and provides high-fidelity playback (e.g. playback by binaural speakers).

8 Claims, 14 Drawing Sheets

FIG.1
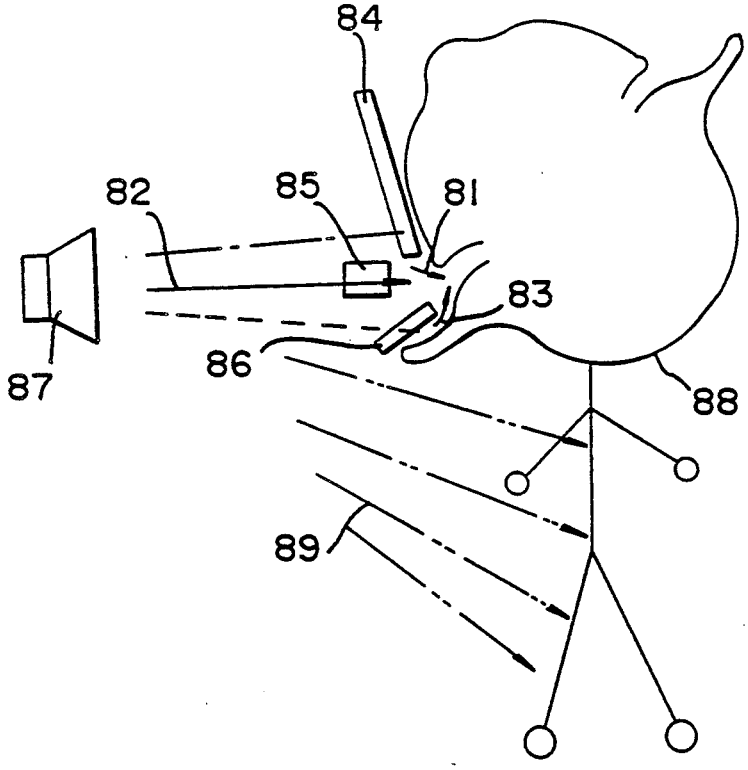
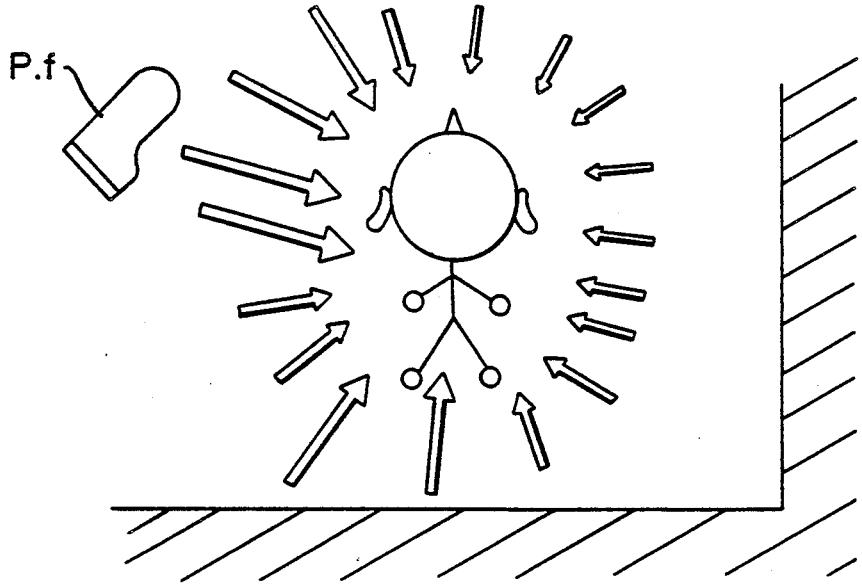
FIG.2

FIG.5A
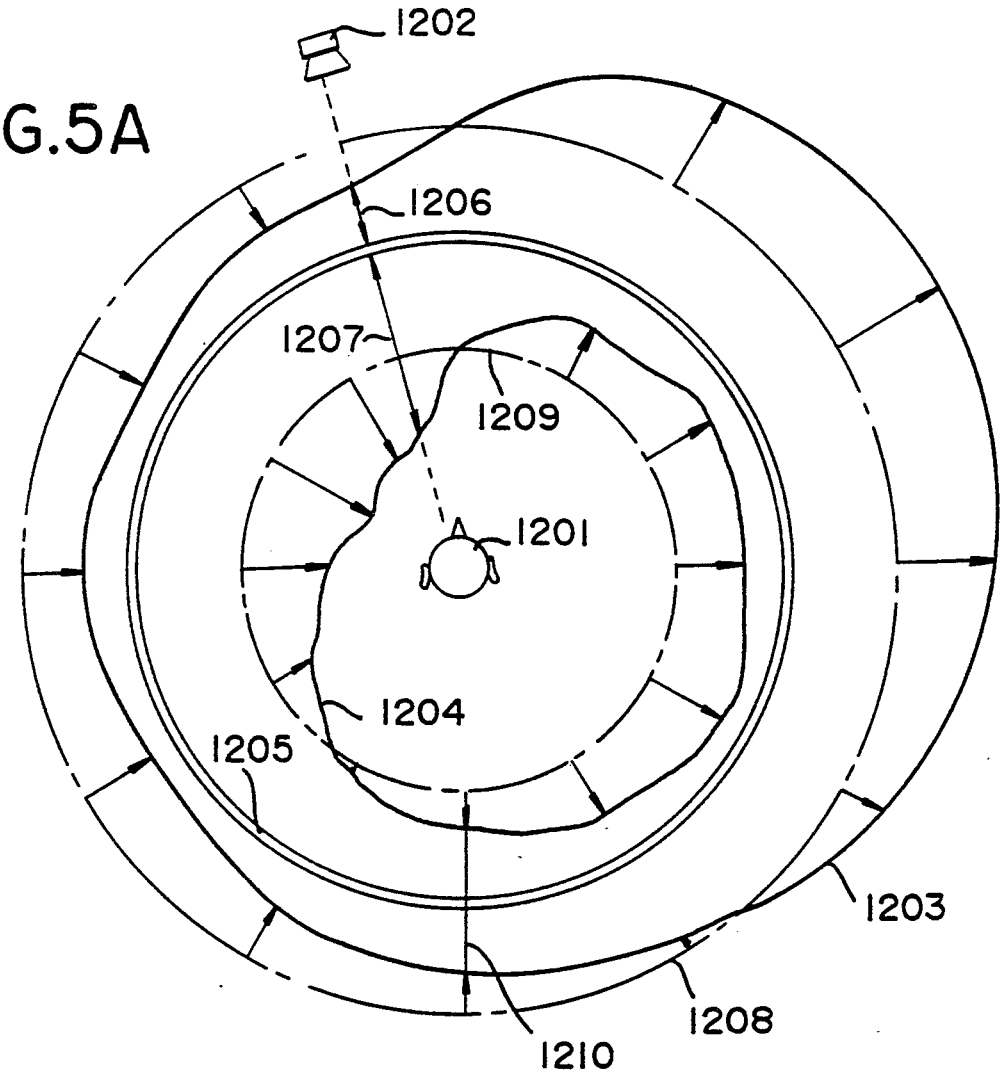
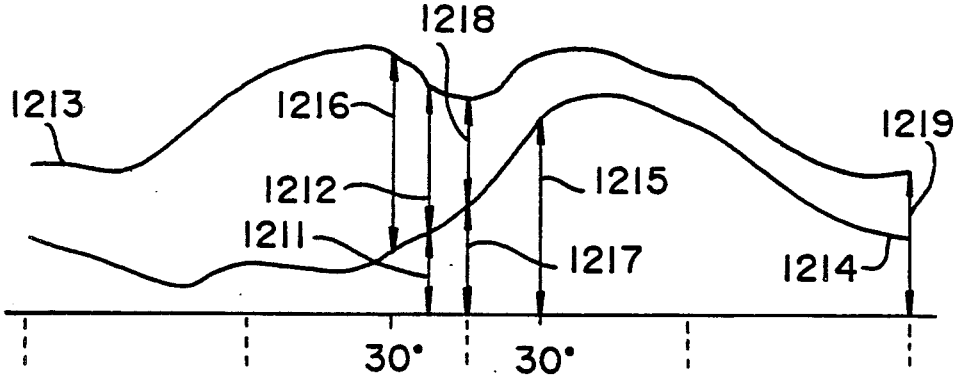
FIG.5B

FIG.9
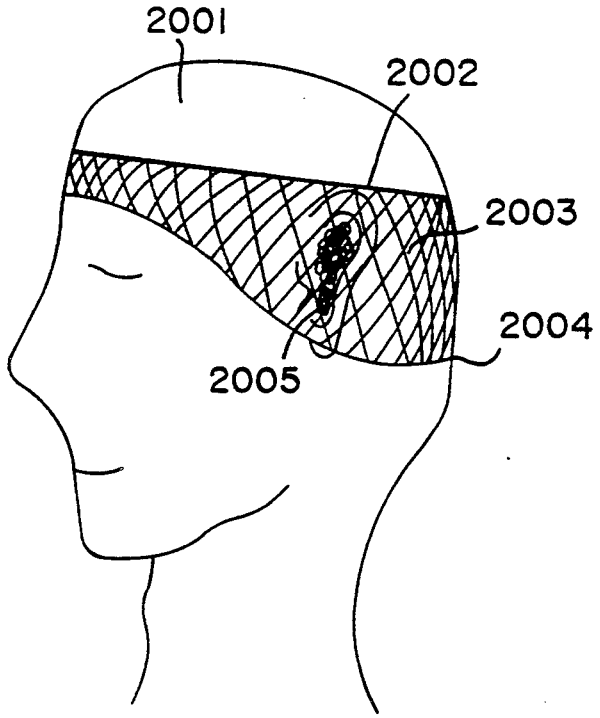
FIG.10
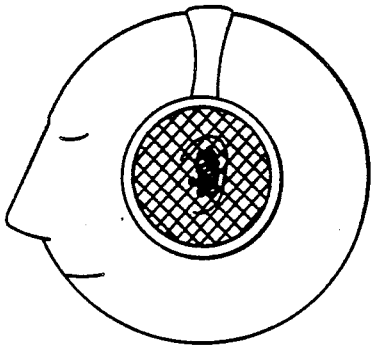
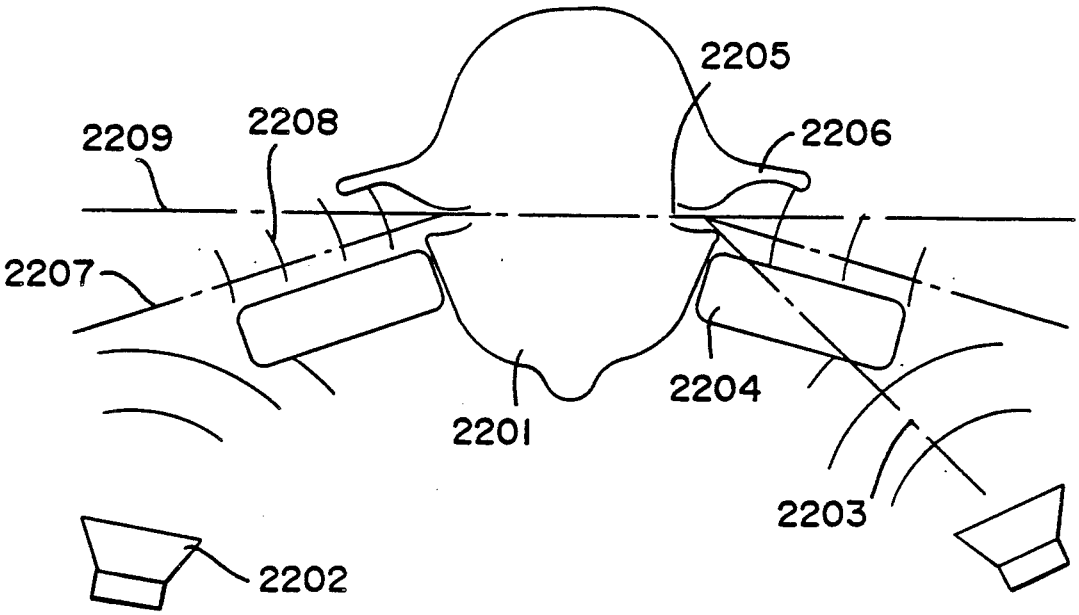
FIG.11

SOUND REPRODUCTION SYSTEM UTILIZING SOUND EXTINCTION DEVICE

TECHNICAL FIELD

This invention is a device to be used in conjunction with an audio device and placed in close proximity to the listener or listening position within the sound area. The purpose of the device is to reproduce the original sound as is. The original sound as is means a recreation of the same orientation of sound source in terms of height, distance and location in the 360 degree horizontal plane, the same presence and the same "sense of sound-pressure balance" (this refers to a balance between the sound pressure that can be received by the auditory organ and that received by the entire body). Particularly when reproduction is from a biaural program source, sound reproduction indistinguishable from the original is possible. This invention concerns a sound reproduction system using a sound extinction device that makes stereo reproduction of this high order possible.

BACKGROUND OF THE INVENTION

The patents listed 1–4 below are related recent technology.

1) Japan patent published 21841/78. This is technology devised to allow only low-level information from the stereo signal source to reach the listener.
2) Japan patent early disclosure 107794/83. This is technology that achieves a sense of sound pressure by sending mechanical vibrations to tissue in the head and face.
3) Japan patent early disclosure utility model 103909/77. This is a method for sending mechanical vibrations directly to the body.
4) Insulated speaker - biaural. This is a method of stereo reproduction that eliminates crosstalk between the right and let signals by means of a sound arresting device placed at the center position of the listener.

Below, (a)–(e), are listed disadvantages with the technology described above.

(a) The listener to stereo sound reproduction is usually within a few meters distance of the speakers. Subsequently, the balance of sound pressure that the listener experiences is from a state of immediate proximity to the sound. This differs greatly from sounds encountered in nature or in a concert situation.

Most program sources are sounds signifying a distant source.

Therefore, there is often a gap between the body's awareness and the experience of the ear. This gap is responsible for the undesirable effect of a "floating" orientation. (Music listened to over headphones present the most extreme instance of the phenomenon.)

For the above reason it is impossible to achieve a stable and earthbound sound experience through the existing reproduction technology.

(b) Regardless of the nature of the program source, it is possible for the listener of a conventional stereo reproduction to clearly identify the location of the speakers. A particular reverberation is created at the listener's head according to the angle at which the sound penetrates. As long as this sound enters the ear, it is easy for the listener to recognize the sound source. Especially in cases such as conventional stereo reproduction, in which the direction of the sound source is simple to describe, this cranial reflection is very strong.

In the above manner, the listener hears stereo superfluous information. Because of the gap that has existed between the genuine image and the "ghost images" from the program source, stereo listeners have always been forced to listen to a peculiarly artificial type of reproduced sound.

Further, even when a biaural program source is used, the cranial reflection effect kills the orientation information included in the biaural system.

Invention (1) described above has the drawback that its effects are negated unless the position, orientation and angle of the head are kept fixed.

(c) It is possible to induce an effect of greater distance from the sound source by increasing the number of speakers, but at the same time, the distance between speakers is necessarily reduced, resulting in greater interference between speakers, increasing distortion. This distortion also kills biaural orientation information, making the enjoyment of biaural program sources impossible.

Japan patent early disclosure 107794/83 and Japan patent utility model 103909/77 contain technology that allows the sensation of sound pressure with headphones and closely-placed speakers, but inasmuch as they apply vibrations directly to the skin, their effect is unnatural.

(d) It is difficult to gain acoustical effects from directly in front of or directly behind the listener through biaural reproduction. This is because it is necessary for the dummy heads used at the time of creation of the program source to be of the same form as the head of the listener. But people have heads of all shapes. For this reason, it was difficult to accept the biaural method as satisfactory for general use.

(e) The present methods of reproduction function with the aid of room acoustics. Yet, as the users' rooms may vary, so will the sound quality. In the traditional methods, therefore, the true image of the program source's creator is not given the respect it is due. What is needed is a reproduction technique that does not depend on reverberation.

DISCLOSURE OF THE INVENTION

To overcome the above described flaws, this invention discloses the following two technologies.

A sound reproduction system that employs a sound extinction device that makes it possible for the proportion of sound pressure that can be perceived by the auditory organ and the sound pressure that is received by the body to be adjusted either in set quantities or according to the desire of the listener, either by distinguishing the mass of the head region sound extinction device and the body region device, or by choosing only one of the two to be operative, or by making the effect of at least one of the two devices variable;

wherein the listening position is defined as a position between the sound production units, and the area near the listening position as the propagation area, and the area within the propagation area and immediately around the head as the head the area within the propagation area but not the head region propagation area as the body region propagation area;

a device that extinguishes sound and can be supported in the head region propagation area as the head region sound extinction device;

a device that extinguishes sound and can be supported in the body region propagation area as the body region sound extinction device.

Another feature of this invention is a sound area reproduction system using a sound extinction device that increases the propagation loss over that which would normally occur in the open space of the head reflection area, and thereby makes it difficult for head-reflected sound to reach the outer ear, where the head reflection area is defined as the space between the sound source and the listener's head position and close to the listener's head position, the sound extinction device is a device that can be supported in the head reflection area, and the head-reflected sound is defined as the sound that comes exclusively from the head after the original source sound has reached the head region.

BRIEF DESCRIPTION OF THE DRAWINGS

FIG. 1 is a horizontal section.

FIG. 2 explains the listener's experience of sound pressure in the sound diffusion area.

FIGS. 5A and 5B show the effect on sound pressure reaching the ear when the sound source is moved.

FIG. 9 is a side view of the listener wearing a mesh belt around the head.

FIG. 10 is a side view; FIG. 11 is a section.

DETAILED DESCRIPTION

Figure 3:
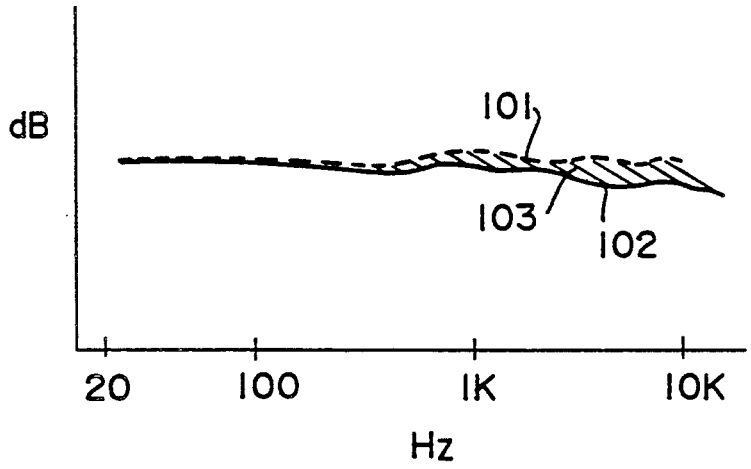
FIG. 3 shows the behavior of the sound-pressure balance within the sound diffusion area.

An example of actual use of the device will be explained in the text below accompanied by FIGS. 1–21.

Sound emitted by the speaker 87 reaches the listener 88 in three ways. These are through direct sounds 82, that enter directly into the outer ear, reflected sounds 83, that reflect from the face and mouth before entering the ear, and sound pressure 89, received through the body.

This invention is constructed so as to reduce reflected sound 83 and/or direct sounds 82, and not reduce sound pressure 89. This sound reduction is accomplished through the use of the sound absorption material 84, 85, 86. Since the sound absorption material 84, 85, 86 reduces the sound pressure to the ear, the effect of the sound pressure to the body is relatively increased.

The sound absorption material 84 can also reduce the sound that reaches the auditory nerve by propagating through the structure of the face.

The original sound source is given the following conditions: a relatively great distance exists between the listener and the source, as between audience and stage in a concert hall, and a diffusion area with reverberations (FIG. 2).

In this situation, the sound wraps around the listener's body, so the sensation of sound pressure is great. The sound pressure experienced by the ear, on the other hand, undergoes almost no change since sound reaches the outer ear without being influenced by the listener's environment. Consequently, in this sort of wrapping sound environment the body's experience of the sound is given greater emphasis.

FIG. 3 exhibits the relative balance of this sensation of sound pressure to the body and to the ear (the sound pressure balance) at various frequencies in a diffusion sound environment.

In the figure, the sound pressure to the body and ear for frequencies below 50 Hz has been given the same value. This is because the wavelengths at these frequencies are so long in relation to the size of the body that they are not experienced differently in a diffusion and non-diffusion environment. In addition, since this diagram assumes an ideal diffusion sound environment, so the sound pressure experienced at the body remains fixed regardless of the wavelength. FIG. 3 reveals that there is little difference between the sound pressures experienced by the ear 102 and by the body 101 (The diagonal lines indicate the differential between the two). This is the balance of sound pressure in a diffusion sound environment.

Figure 4:
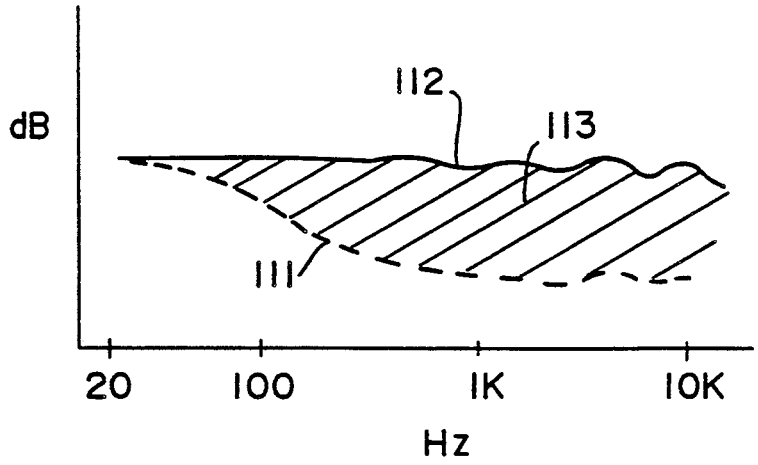
FIG. 4 shows the behavior of sound-pressure balance in a monaural reproduction environment.
Figure 6:
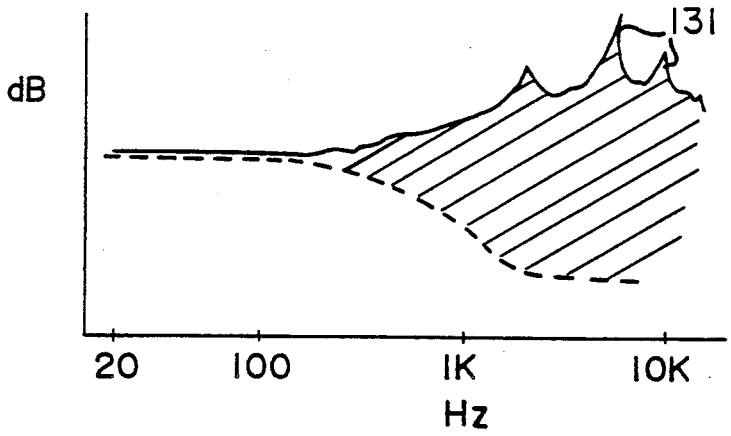
FIG. 6 shows the sound-pressure balance for the stereo listener.

FIG. 4 shows the sound environment with a single speaker source. The speaker is 2 meters from the listener, and the room is dead to prevent interference.

The relation between the two differs greatly from that depicted in FIG. 3. The sound pressure at the ear is greater the that experienced by the body by the large differential indicated on the graph by diagonal lines 113 (This is unaltered by support of the transmission frequency specific with a graphic equalizer or similar equipment). This relation occurs now only when sound is reproduced through a speaker, but applies equally with an original sound source placed the same distance from the listener.

Setting is defined as a difference of sound pressure to the body equal to the sum of the areas 103 and 113; the areas between curves in FIGS. 3 and 4. It is necessary to make a relative reduction in this gap. This can be achieved by means of sound absorption material like 85 in FIG. 1, which reduces the sound directly entering the outer eat.

In the case of the usual stereo reproduction setting (speakers open to 60°), the above-described tendency becomes even more pronounced. This is explained below:

FIG. 5 is a circular diagram of the sound pressure occurring in the listener's right and left ears. Speaker 1201 revolves around listener 1201 emitting white noise. The sense of sound pressure experienced by the listener in this case will be the same regardless of the position of the speaker.

Consequently, the levels of reception indicated in the circular graph also express the relation of the sound pressure experienced by the head and that experienced by the body. Line 1203 is the sound pressure measured at the entrance to the outer right ear. Line 1204 is the sound pressure measured at the outer left ear.

The measured sound pressure is shown by the radial distance between the boundary line 1205 and lines 1203 and 1204. For example, if the speaker 1202 is at an angle of 15° forward and to the left of the listener, the value derived by measurement at the right ear will be the radial distance 1206 and that at the left will be 1207. These distances determine the lines 1203 and 1204.

The results of measurements at all angles are represented by the radial distance between the boundary line 1205 and the above lines in the same way. The base lines 1208 and 1209 show the frontal measured sound pressure for both right and left, and are drawn so as to facilitate comparison of the sound pressure measured frontally with other measurements.

The lower diagram in FIG. 5 is the same graph cut at the radial 1210 and displayed along a horizontal axis for easier interpretation.

When speaker 1202 is located 15° to the left in front of the listener, the measured value for the sound pressure at the right ear is shown by the difference 1211. The results of sound pressure measurement at the right ear with variable sound source are represented by the line 1214, 1212 is the measured sound pressure at the left ear, which has been shown added to the value for the right ear. It is possible to read the difference in sound pressure at the right and the left ear and the cumulative pressure for both ears from the vertical distance between lines 1213 and 1214.

Now I will briefly discuss the reasons that the balance of sound pressure is particularly poor in normal stereo sound listening. The usual speaker setting in stereo listening situations is 60°. The sound pressure at the right ear in this instance is represented by the difference 1215, and that at the left by difference 1216. The total sound pressure at both ears is therefore the sum of 1215 and 1216; this is the volume of the sound reaching the listener's ears when listening to stereo reproduction.

In the case of monaural, the sound pressure at the right ear is 1217, and the right is 1218. Again, the total sound pressure to both ears is the sum of 1217 and 1218.

The total sound pressure when calculated in this way, is clearly greater for stereo than for mono. This is because in the case of stereo, the two speakers are positioned in locations to which each ear is sensitive.

When reproduction of sound from behind the listener is attempted with speaker biaural reproduction, as shown by the difference 1219, the sound pressure at the rear is low revealing the difficulty of achieving this with two front-positioned speakers.

It is clear from the above that unlike the cases of a single live sound source and monaural reproduction, in stereo reproduction the sound pressure balance is toward the ears. That is, it is a sound environment unlike natural sound. These shortcomings can be overcome by increasing the thickness of sound absorption material like that shown in FIG. 1. Highly sound insulating materials like glass could also be used.

There are other problems apart from those described in FIG. 5. These involve reflected sound from the head. They are explained in FIG. 6. A listener facing in a fixed direction experiences the large peaks 131 always at the same frequencies.

Since the speakers are set opposite each other, all sound is concentrated at the swing angle (usually 30° from frontal), causing these peaks to appear very pronounced at the indicated frequencies. Consequently, the sound pressure balance leans heavily toward the ears.

Figure 7:
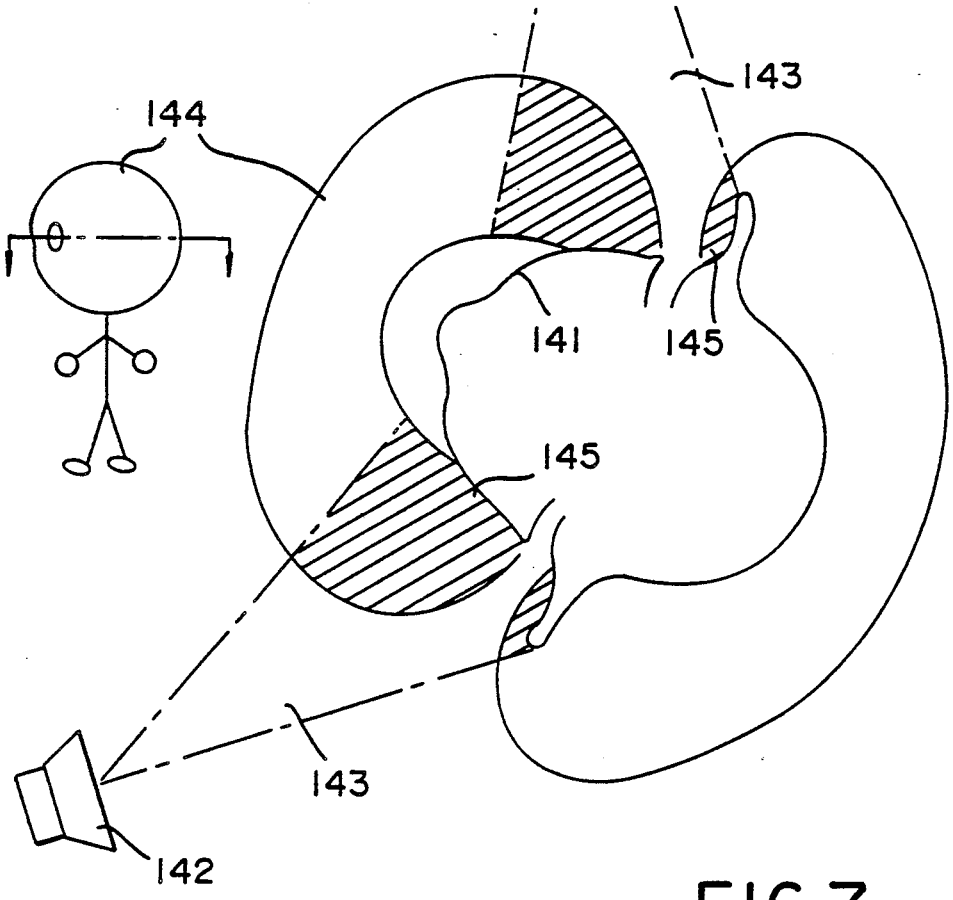
FIG. 7 is an aerial view of a section through the listener's head.

The above problems can be prevented by the peak-eliminating and absorption capacities of the sound absorption devices 84 and 86 shown in FIG. 1. FIG. 7 shows a test situation in which these results were achieved. The shaded region 145 is the portion of the sound absorption material doing the most work.

That is, the region 145 is where the sound absorption material overlaps with the area of sound interference from the head on the path between the speaker and the auditory organ. The propagation loss caused by this sound absorption material eliminates the above described peaks, and steadies the sound pressure balance.

In addition, this sound absorption area changes according to the relative position of the listener and speakers. In the figure, however, the speaker position has been set, and so the area 145 remains fixed too.

Explained below is a test case in which the transmission-related distortion is further decreased.

First, ideal operating conditions are described.

1. A sound source with minimal distortion should be used (i.e. speakers with no speaker box vibration and sound division).

2. A small sound source is preferable—the larger the sound source, the more distortion will result from change in listening position.

3. High-quality reproduction should be offered, while still allowing the listened a degree of free head movement.

FIG. 7 shows the method for achieving the most desirable sound reproduction in the above described conditions. Absorption material 144 is supported by the head and absorbs sound reflected from the head. This makes it possible for the listener to hear direct sound while substantially reducing the reflected sound.

All of the material except for the shaded area 145 could actually be removed. This method produces low-distortion sound transmission incomparably better than that achieved by the previous electronic reverberation canceling technology (Japan patent published 21841/78).

To remove only the peaks created by sound reflection from the head, there are possible substitutes for sound absorption material 144. For example, a complicated arrangement of several reflecting panels can be used. And the phenomenon of earache peculiar to stereo listening can be avoided. However, normal position information becomes confused when a biaural source is used, so it is unsuitable.

The following test case was devised with the aim of reproducing a biaural program source.

The task of the sound absorption material 144 is to sufficiently remove head reflected sound, which has the damaging effect of masking biaural normal position information.

Therefore, the sum volume of the absorption material is best made equivalent to or greater than the volume of the head. If good material is chosen for the absorption device, there will only be variation according to frequency. Consequently, biaural normal position information will be able to reach the outer ear unimpeded and unchanged. In comparison with Japan patent published 21841/78 (a device that mixes signals canceling head reflected sounds at the signal sound source), this device has the advantage of eliminating head-reflected sound regardless of the listener's head size or orientation. For these reasons, this invention brings about ideal speaker biaural reproduction.

Below is an explanation of tests in which the sound pressure balance of the original recording environment are faithfully reproduced, and sound reproduction becomes virtually indistinguishable from the original source.

In the conditions for sound pressure balance described in FIGS. 1 through 5 above, the best that could be achieved was a compromise involving expression of low-level sound pressure balance.

Figure 8:
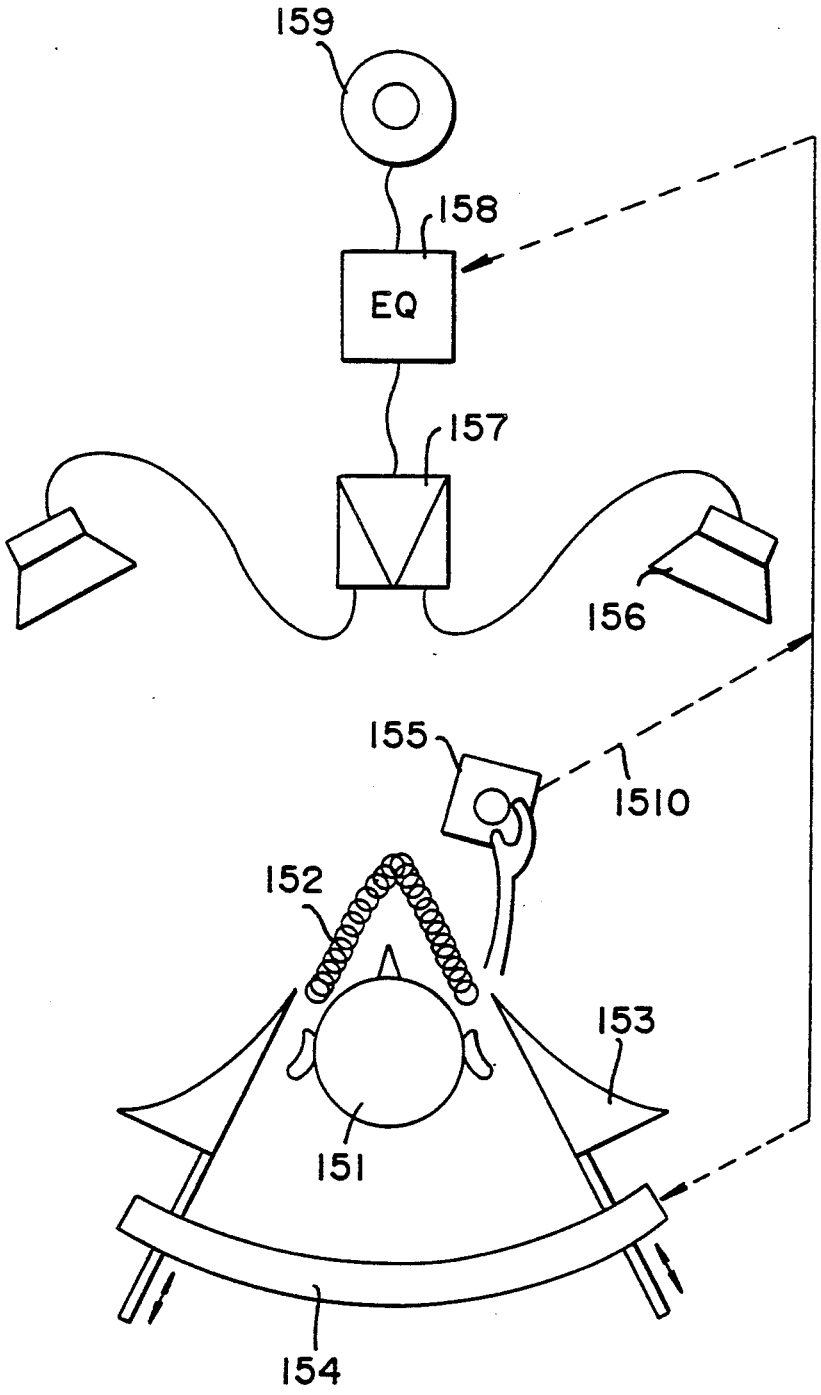
FIG. 8 shows the device and the stereo system from above.

FIG. 8 shows a method for producing modifiable sound pressure balance. The listener 151 affixs sound absorption material 152 (of the same properties as the material 144 described in FIG. 7) to a headphone-type device that supports it in proximity to the face (support device is not illustrated).

The control box 155 is manually operated. The flexible sound absorption material 153 is positioned on either side of the listener's head. The degree to which the path of sound propagation between the speaker 156 and the listener 151 is blocked may be altered by means of various combinations of the variable sound absorption material and the variable power unit 153. This is the composition of the sound extinguishing device in this invention.

The audio system includes speakers 156 set at 60° connected to an amplifier 157, a program source 159 and an automatic variable equalizer 158.

In this test case, adjustment of the sound pressure balance is made possible by the variable sound absorption material 153.

As the thinner portion of the sound absorption material 153 is brought closer to the listener's ear, the sound pressure balance also comes closer to the ear. This is the sound pressure balance for a sound source extremely close to or above the listener. If, on the other hand, the thicker portion of the sound absorption material is adjusted close to the ear, the sound pressure balance reorients toward the body. This is the sound pressure balance for a sound source far from the listener or a dispersed sound source.

According to regulation of the sound pressure balance as described above, the high-range sound absorption level of the absorption material varies widely. By changing this with the automatic variable equalizer 158, the transmission frequency specific is kept level. When the speakers are moved, this functions in place of adjusting the position of the sound absorption material.

Here we will discuss the information upon which control of the sound pressure balance is based. The simplest method is to have the listener himself adjust with the control box 155 according to the type of recording hall etc. The command signals from the control box were devised as follows:

a signal from the measured sound pressure balance in the recording environment;

a signal manufactured by the programmer;

a signal derived from measurement of the program source's biaural correlation coefficient.

Figure 14:
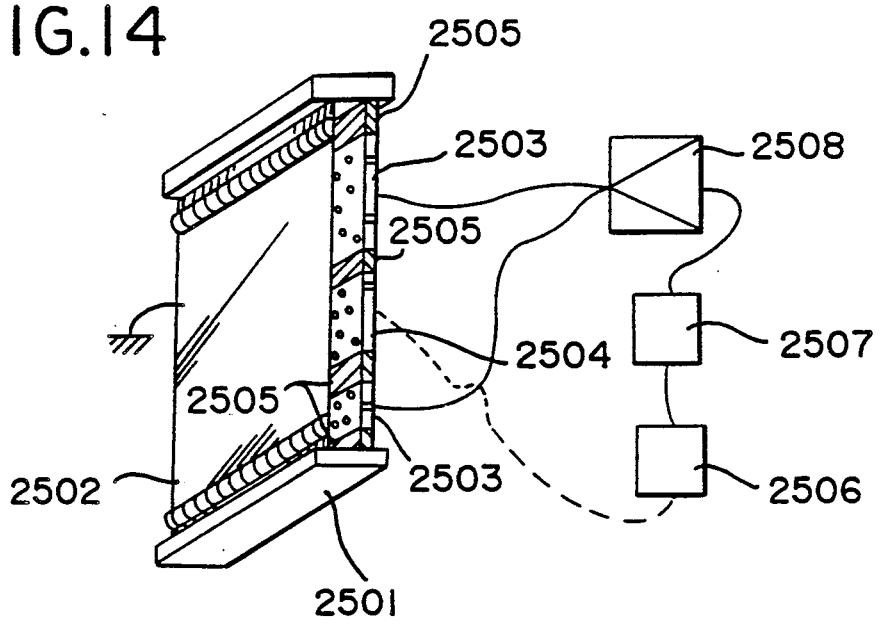
FIG. 14 shows the MFB-based sound canceler.

If the electronic sound wave damping structure described below in FIG. 14 is used for this variable sound absorption device, even better control is obtainable.

FIGS. 9 and 10 show a test case in which a greater quantity of reverberation from the listener's head were successfully reduced.

Referring to FIG. 9, the listener 2001 draws the mesh band 2004 over his/her head as depicted. The band holds the ears against the aide of the head. This alters the shape of the ear so that the reverberations that would occur at the ear are artificially removed. One can also attach sound absorption material in the shell of the outer ear. This will reduce the ear's capacity to receive sound, and will also keep the mesh band from shifting position. This equipment is used in combination with other sound absorption material. It will increase the efficiency of the sound absorption material 144 shown in FIG. 7. It could also be applied in a manner similar to headphones (FIG. 10).

In a reproduction system where speakers with poor specifications are used, there is no need to carefully reduce the transmission distortion of the sound extinguishing material. In this case, it is better to design the sound extinguishing device to be compact. FIG. 11 illustrates a test case in which this was done. The listener 2201 listens to speakers 2202 with sound blocking material 2204 affixed to the head. The sound blocking material is made with a substance that refracts sound easily. It is set in a position to block the sound propagation path 2203 between the speakers and the listener's outer ear 2205. The refracted sound propagation path 2207 is the path of the refracted sound 2208 produced at the sound blocking material.

This refracted sound propagation path is at an angle closer to the axis linking the eats 2209 than the sound propagation path 2203. The directional orientation of the refracted sound propagation path undergoes complex changes when the frequency of the sound passing through it changes. Because of this, it will remove the peaks reflected from the head in the same way the sound absorption material 145 does for conventional music reproduction. The listener is able to listen to the music without the awareness of the presence of the speakers and the sensation of pressure that are characteristic of reproduced sound. In addition, reverberations from the face can be sufficiently reduced by means of adjustment of the distance between the sound blocking material 2204 and the face.

Figure 12:
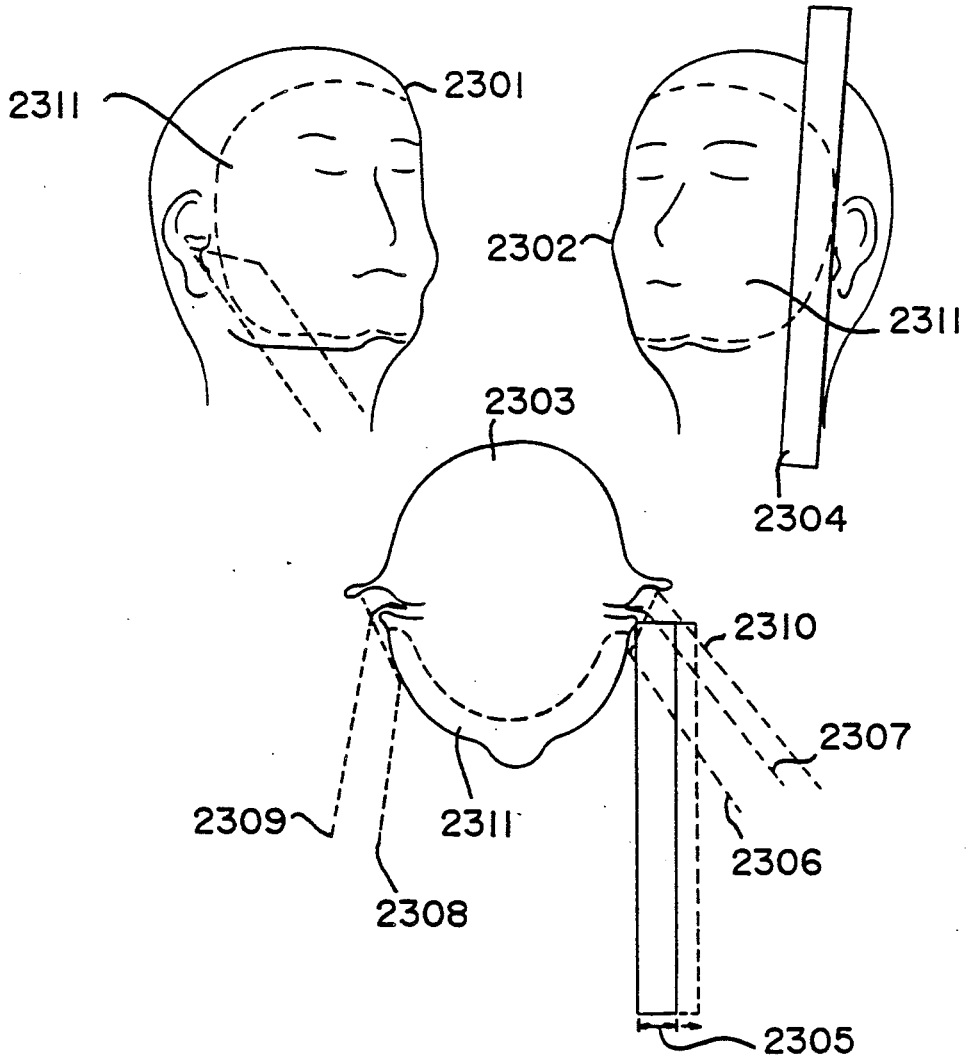
FIGS. 12 and 13 demonstrate a device that enhances the sense of static position from the front.

In the past, it has been necessary to make the biaural recording dummy heads as similar as possible to the listener's head. If this is not done, one cannot obtain a frontal normal position. FIG. 12 illustrates a test case in which this problem was solved.

A dummy head different in shape from the listener's head was used in recording the biaural program source. For the purpose of explanation, sound absorption material 2004 was attached to only the left side of the head. The sound source was a pair of speakers set at normal. The face on the left 2301 demonstrates the listening situation for the left side, and that on the right 2302 demonstrates the same test for the right. The section drawing 2303 shows how the sound enters the ears.

The sound that enters the listener's ears can be divided into direct sound and head-reflected sound. The direct sound is indicated 2307, 2309 in the diagram, 2306 and 2308 are the head reverberations that occur at the frontal reverberation region 2311 (indicated by a dotted line around the face). These reverberations 2306 and 2308 are the information that make the listener aware of the frontal direction.

The unique characteristic of this test case is that sound extinguishing material was not placed in proximity to the frontal reverberation region. Now we will explain the effect on listening in the instance on the left (refer to face 2302 and section drawing). The sound that reaches the listener is a combination of direct sound 2307 and head-reflected sound 2306 which reverberates at the frontal reverberation region 2311. We have devised that the head-reflected sound reaches the outer ear after being partially but not completely eliminated by the sound absorption material 2304.

Sound received by the ear with this sort of sound extinguishing material in use will include the normal position information that is blended into the program source unaltered.

And the reverberations that occur at the frontal reverberation region have the effect of drawing the normal position to the front compensating for insufficient frontal normal position capacity. That is, no matter what biaural program source is listened to, the frontal normal position can be obtained. It is further possible to alter the degree of reduction of head-reflected sound and earshell reverberations (these have less effect than the head reverberations 2306, but are believed to have some relation to the frontal normal position), by adjusting the thickness 2305. This makes possible a subtle balance of the sensation of frontal and other normal positions.

Figure 13:
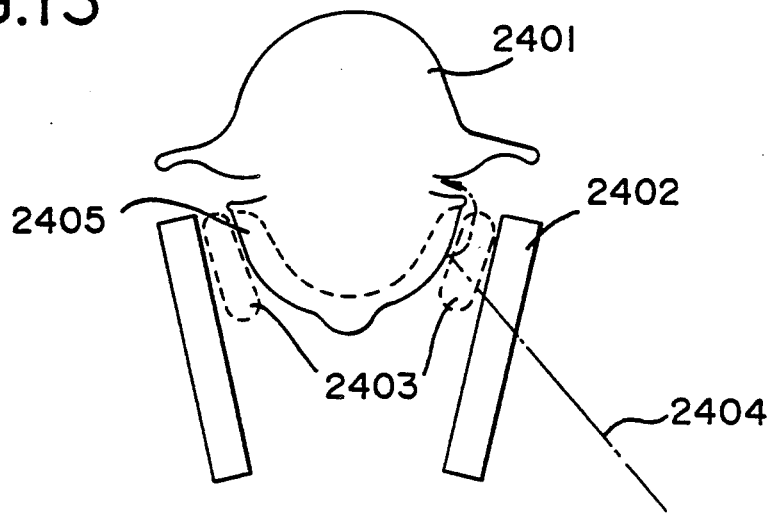

FIG. 13 illustrates a test using the same biaural program source discussed above, but further increasing the strength of the frontal normal position. The sound absorption material 2402 here is the same as 2304 above. It differs in that the gap 2403 is made adjustable.

The effects of this gap are as follows: Natural reverberation conditions can be maintained at the frontal sound reverberation area 2405.

Head reverberations 2404 are effectively reduced.

The sound absorption material does not come in contact with the listener's skin.

FIG. 14 shows a test in which the sound extinguishing device was made electrical. Electrical sound wave extinguishing device 2501 is a sound extinguisher with controllable transmission characteristics. The circuit is, simply put, the same as that of an MFB (Motional Feedback) speaker. In this test a condenser type was used.

The active electrode 2503 and the sensor electrode 2504 are placed flat with the insulator 2505 between them. In front of this, the vibrating electrode 2502 is placed and the assembly is grounded.

This is the basic structure. The electrical system includes phase compensator 2506, filter 2507 and amp 2508.

The device is set so that sound passes through it just before reaching the ear. The vibrating electrode is caused to vibrate by sound pressure from the speaker. This variation is picked up by the sensor electrode. The signal is magnified by the amp and sent to the active electrode. This causes the vibrating electrode to vibrate. The phase correction device controls the phase so that the vibrating electrode can extinguish the sound passing through. The filter 2507 controls the amplitude of sound pressure extinguished at a desired frequency.

The above method produces fine results for the small area in the immediate vicinity of the ear. Absorption of low range sounds of less than 100 Hz is possible, and frequency characteristics and the degree of reduction are freely controllable.

Figure 15:
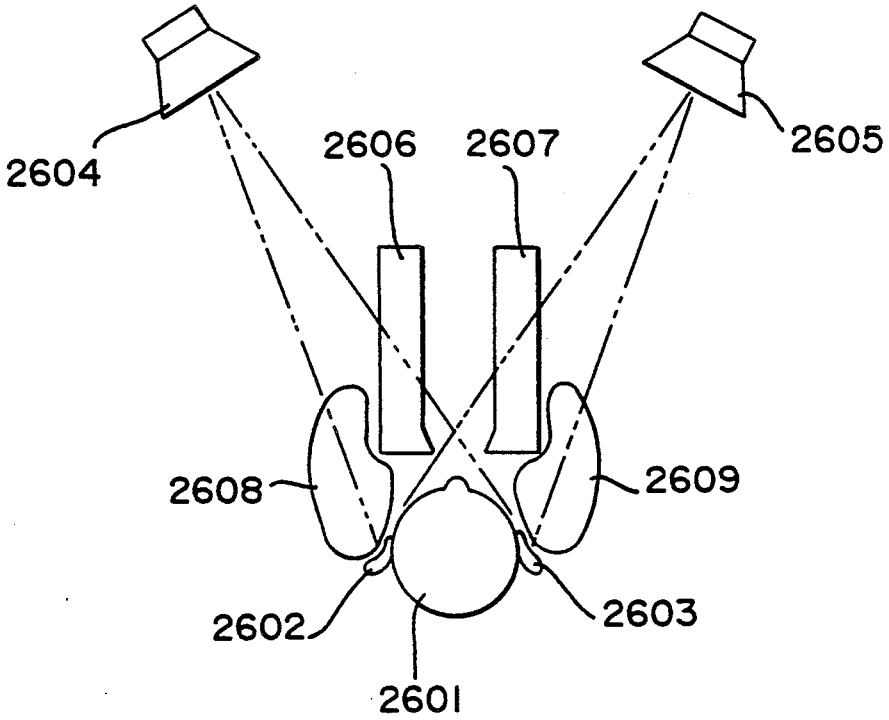
FIG. 15 is a view from above of imaging devices being used to eliminate crosstalk.
Figure 16A:
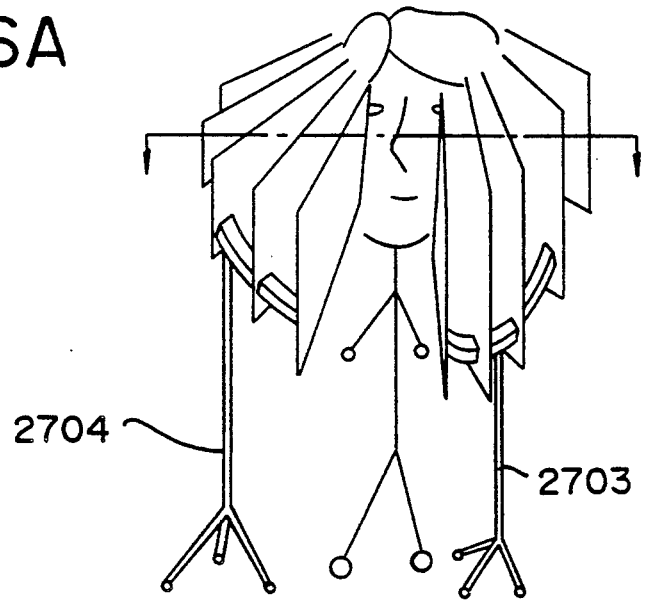
FIGS. 16A and 16B show a two-section sound absorption arrangement.
Figure 16B:
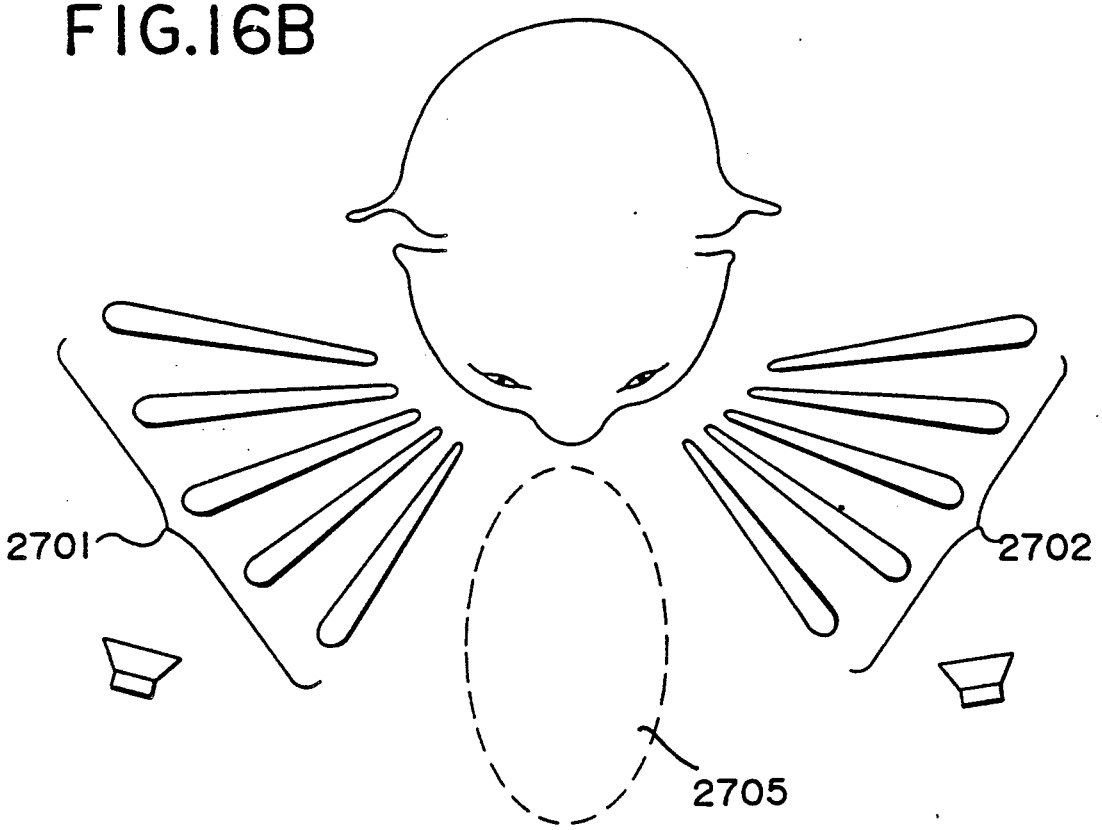

FIGS. 15 and 16 illustrate a test intended to solve the problem of crosstalk that arises in stereo reproduction. Aspects of the problem are listed below.

(a) With high levels of crosstalk, biaural speaker reproduction is impossible.

(b) Previous solutions to the problem of crosstalk have involved setting a screen in front of the listener. This has the obvious disadvantage of blocking the listener's field of vision, making audio-visual applications impossible, among other things.

(c) The elimination of crosstalk and the maintenance of a broad field of vision have thus been mutually exclusive.

The method illustrated in FIG. 15 offers a solution to problems (a) and (b) above.

The right video monitor 2607 is set in front of the right eye of the listener 2601. It is also set in a position so as to block the sound propagation path between the right speaker and the left ear. In the same manner, the left-side video monitor is positioned in front of the left eye in such a way as to block propagation from the left speaker to the right ear.

Sound absorption material 2608 and 2609 (identical to sound absorption material 85 and 144 described above) has been affixed to video monitors.

By placing video monitors so as to function as screens against audio crosstalk, the sound screens that had blocked the listener's vision are converted into a source of visual stimulation themselves. At the same time, they remain fully effective in preventing crosstalk.

The test case illustrated in FIG. 16 offers a solution to problem (c) mentioned above. This method was designed to give priority to listening pleasure. Sound absorption material to eliminate head reverberations has been broken into two groups, right and left (2701, 2702). The sound absorption material in each group has been attached by fixed cross-pieces 2703, 2704 in a radial arrangement projecting out from the viewpoint of the listener. Arranged in this fashion, even a large number of sound absorption panels will not severely interfere with the field of vision. Also, by leaving sufficient space open between the two groups of sound absorption material (2705), the unpleasant sensation of a blocked field of vision can be largely eliminated.

Figure 17A:
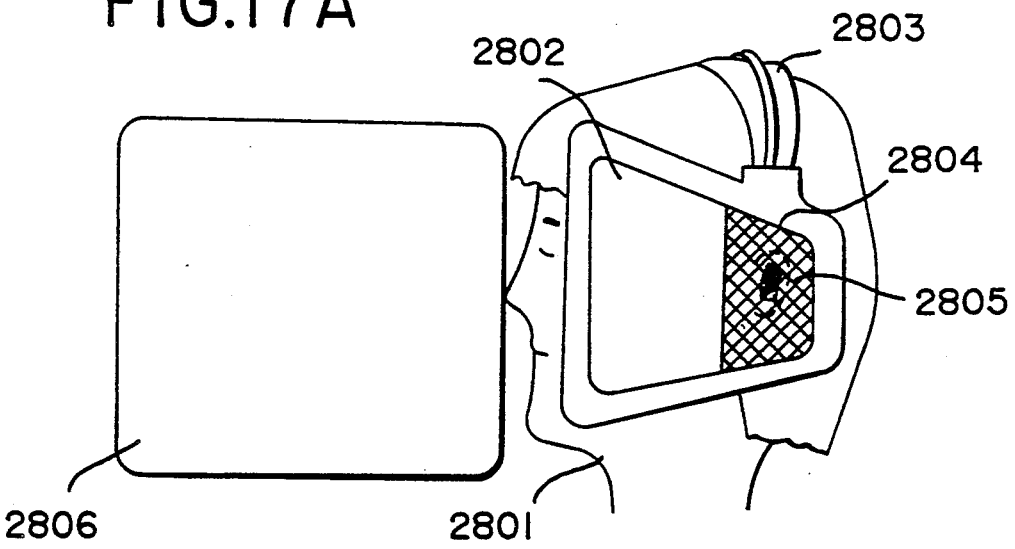
FIGS. 17A and 17B show a head-mounted sound absorption arrangement.
Figure 17B:
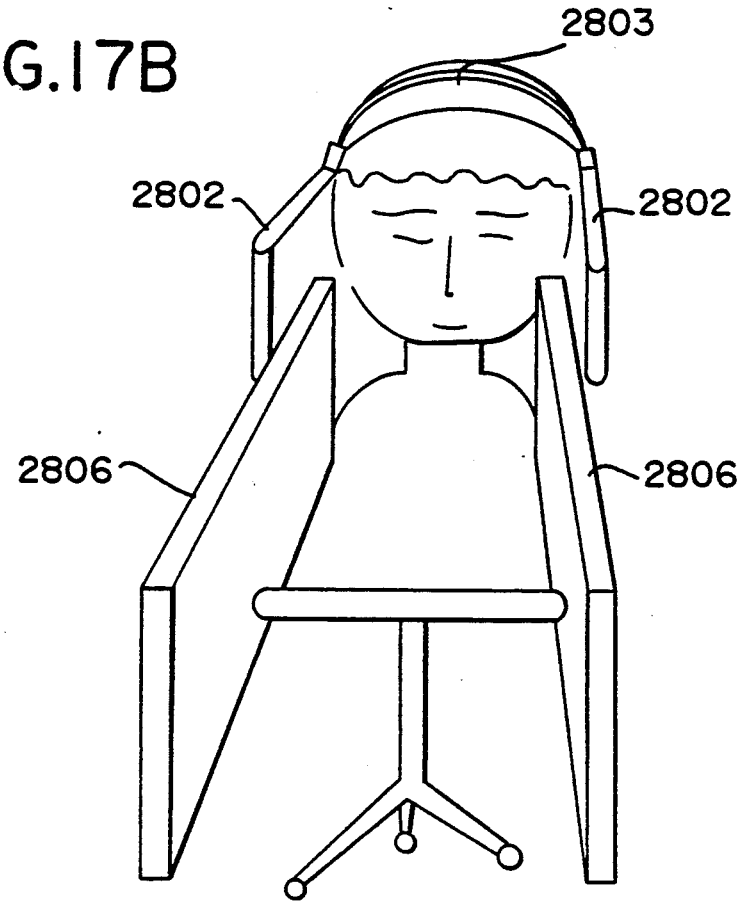

The closer the proximity of the sound absorption material to the listener's head, the better the results. However, bringing the sound absorption material closer to the head also restricts the freedom of the listener. FIG. 17 illustrates a solution to this difficulty. The device is made up of the following elements:

sound absorption material for reverberations from the outer ear 2805; net to alter the shape of the ear; a sound extinguishing device 2802, relatively small in comparison to the size of the listener's head; headset 2803 to hold all of the above firmly in position on the listener's head; and a supplementary sound extinguishing device 2806, supported separately from apparatus attached to the listener's head by headset 2803.

Once the smaller sound absorption device in the above description has been attached to the head, the listener may move about freely with it on. When the listener returns to a position in front of the supplementary sound absorption device 2806, he can listen in the same conditions each time.

Next is a test case in which the normal position changes caused by the listener's turning his head are made yet closer to those experienced with natural sound. The program source is biaural.

The listener's position is always changing subtly. This movement (particularly lateral movement), and the changing normal position information that accompany it are very significant.

Figure 18A:
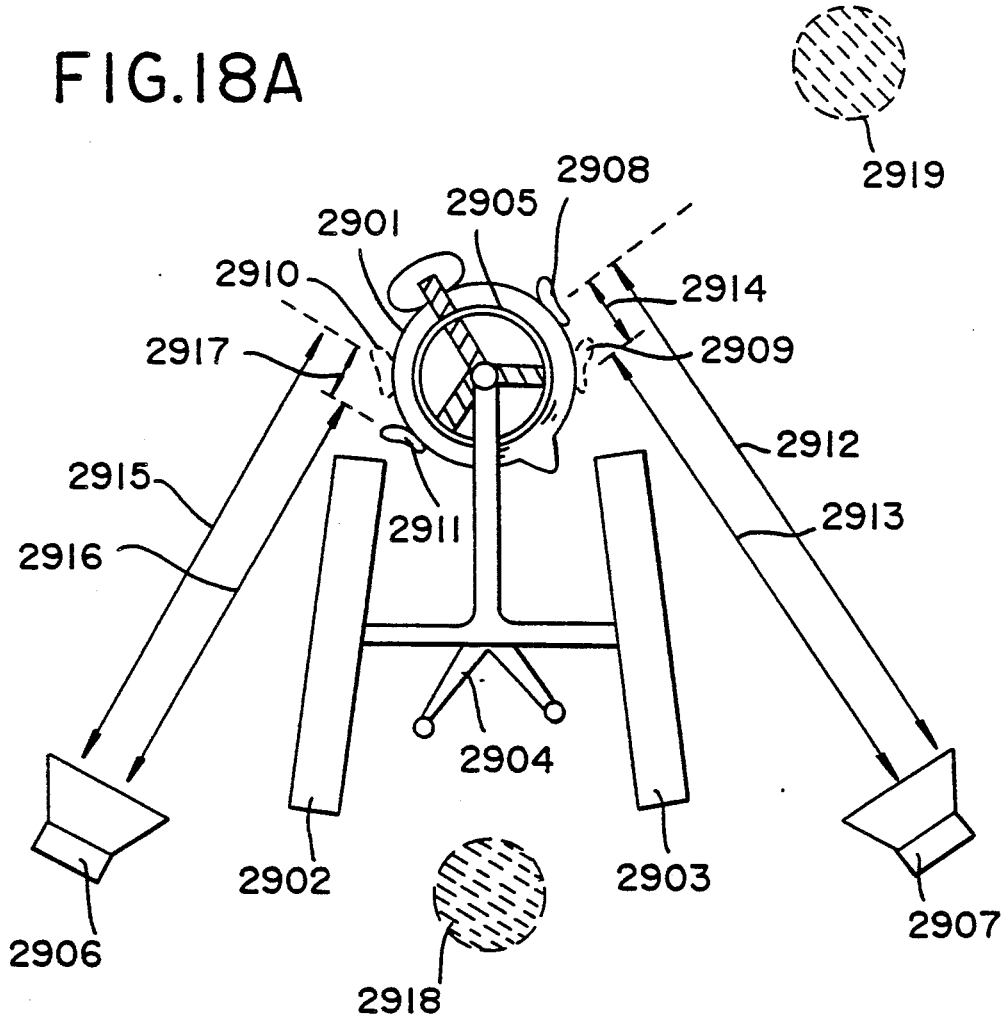
FIGS. 18A and 18B show a device for holding a fixed position.
Figure 18B:
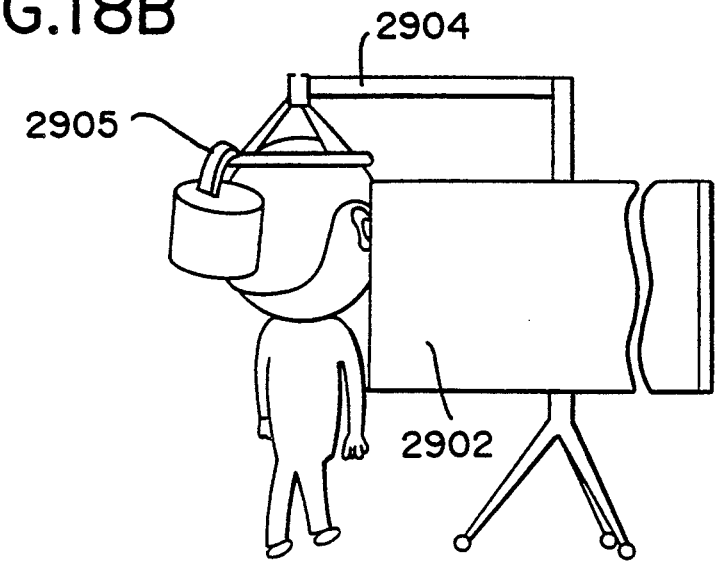

FIG. 18 illustrates a test in which the listener hears normal position variations accompanying movement like those experienced with natural sound.

The device in FIG. 18 contains the following elements: a restraining device 2905 that permits movement of the listener's head 2901; sound absorption material 2902, 2903 to eliminate reverberations from the head; a stand 2904 to support the entire apparatus.

The listener's face is directed to the left in relation to the speakers 2906, 2907. The ear shapes rendered with a dotted line indicate the position of the listener's ears when the listener is facing front. The program source is biaural. For the sake of simplicity, the contents of the recording were focused at positions 2918 and 2919 front center and back left in relation to the listener.

When the listener's head is allowed to rotate around one fixed axis, a new effect occurs. The principle of this is explained below.

The audio system was adjusted so that when the when the listener's ears are in frontal positions 2909 and 2910, the sound will be heard from focal points 2918 and 2919. In this configuration, the distance from each speaker to the ear is indicated by the lines 2906, 2907 respectively. These distances should be set the same normally, and are so here. This much is identical with the usual listening arrangement, and will naturally produce satisfactory results. However, when the listener moves his head to the left (indicated by the solid line rendition of the head), the following problems arise.

1) The distance between the position of the right ear 2911 and the speaker 2906 becomes distance 2916. There is a difference, indicated by line 2917, between the distance from speaker to ear now and that when the listener is facing front. Meanwhile, the left ear position 2908 becomes farther from the speaker 2907 by a distance of 2914. This produces the Haas effect, in which sound from the left speaker is given too much weight.

2) The above conditions and the orientation of the ear exacerbate the imbalance of volume (right being stronger and left weaker). Consequently, the experienced sound position moves away from the focal points 2918 and 2919 and toward speaker 2906.

The restraining device 2905 and sound absorption material 2902 exhibited in FIG. 18 serve to reduce the extraneous normal positions brought about by the conditions described above. They operate as follows.

An instance in which the listener's head moves from frontal position (ear positions 2909, 2910) to the side (ear positions 2908, 2911) will be discussed.

The sound absorption materials and the pivot of restraining device 2905 are fixed. When the listener moves his head, the following phenomenon occurs.

According to the degree to which the head is rotated, one ear is hidden from the speaker, while the other ear is oriented more directly toward the speaker. The listener may move his head freely, and the sound will always appear to come from a fixed point, as with natural sound (although it is here induced artificially).

Figure 19:
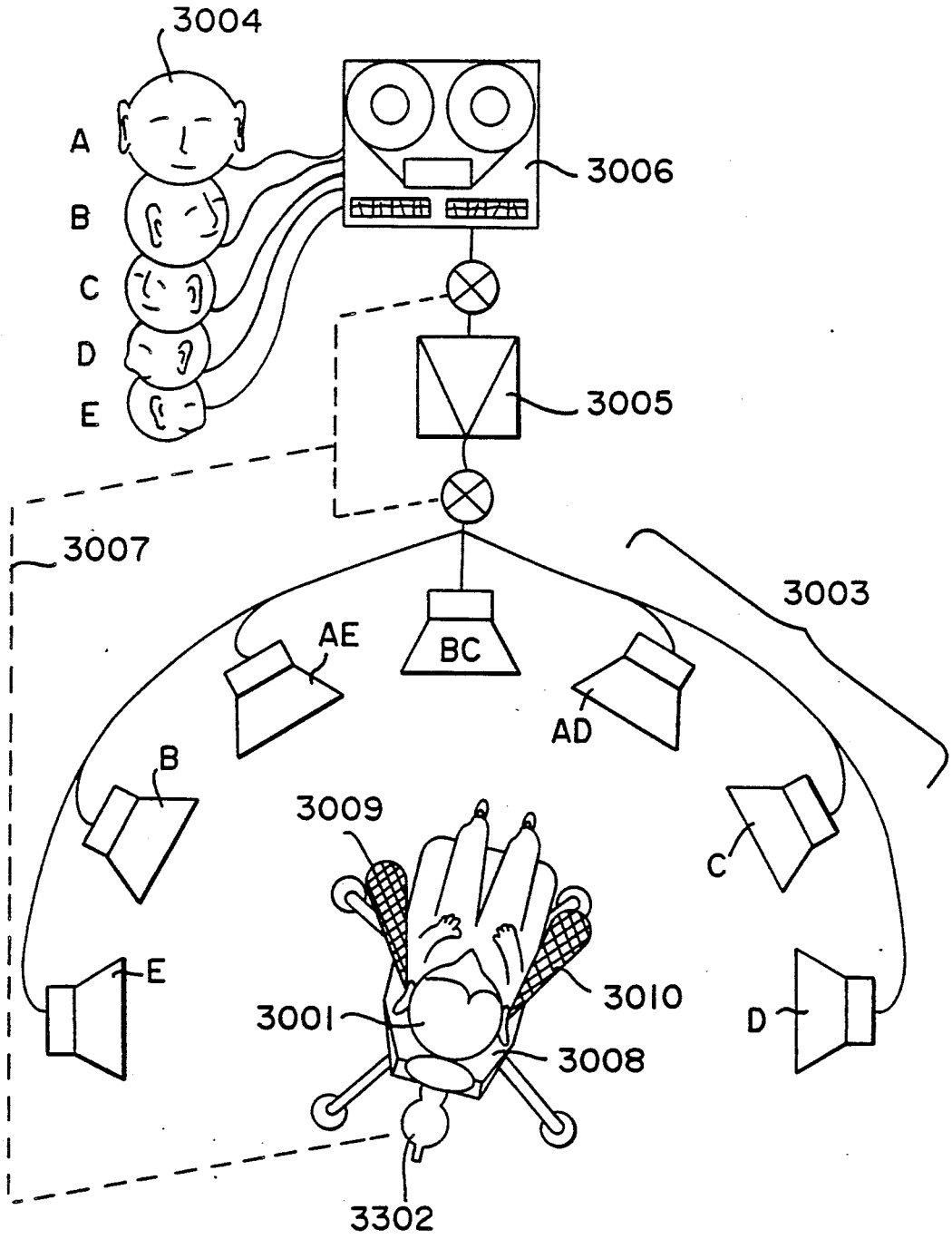
FIGS. 19 and 20 explain the functioning of the sound extinction device when used with a multi-channel program source.
Figure 20:
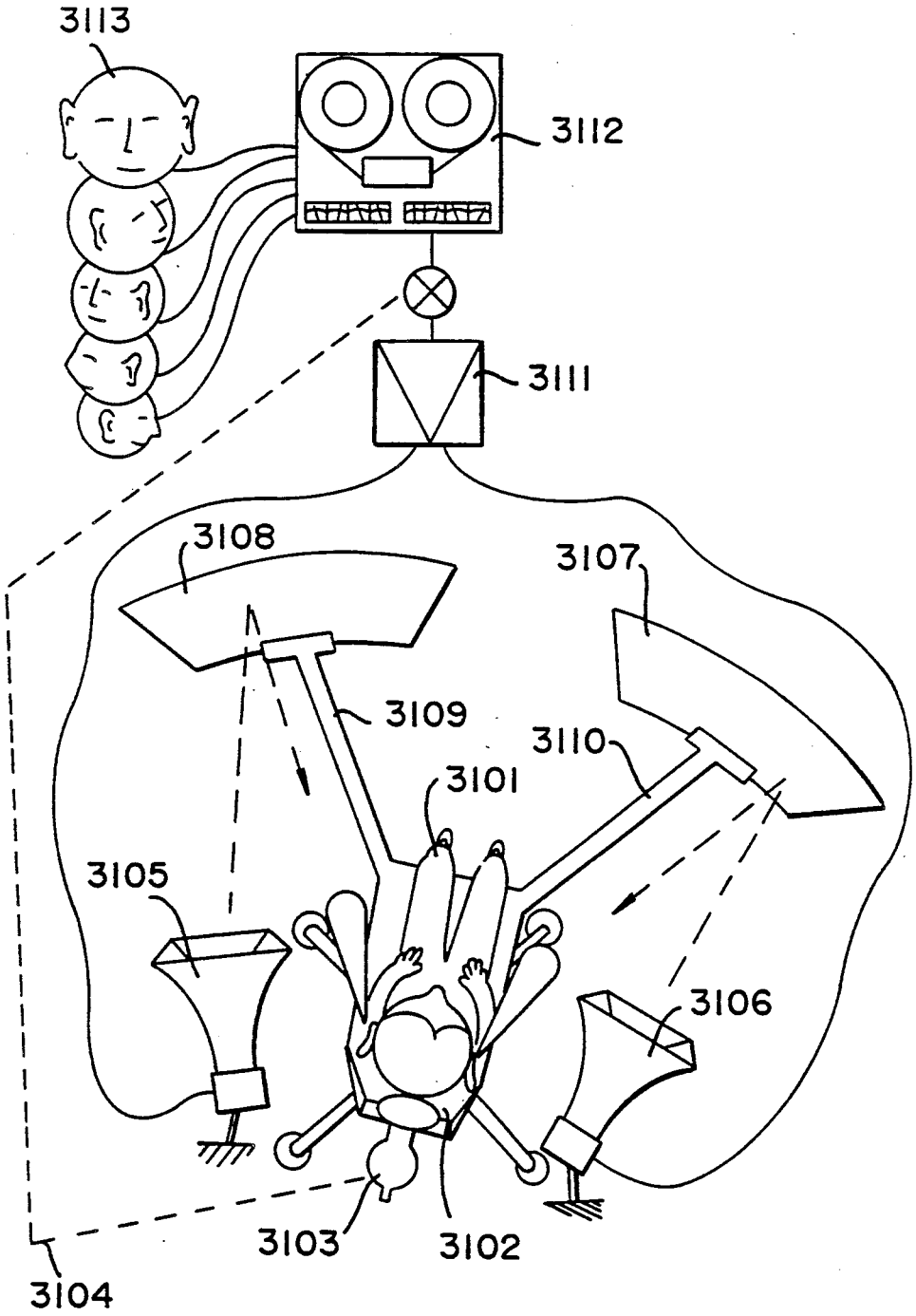

FIGS. 19 and 20 illustrate at test case in which the changes in the sound environment accompanying the movement on the listener's head were reproduced with ideal conditions. The characteristics of this apparatus are described below.

The apparatus was attached to a swivel chair. A recording made with multi-channel dummy head mikes was used. The speakers were set so that sound came from several directions. (An number of speakers could be used, or alternatively, one movable speaker).

To determine the movement of the listener's position, a selector and gyroscope were used on the supporting post of the swivel chair.

The test in FIG. 19 involves free use of numerous speakers and amplifiers. FIG. 20 illustrates a simple test.

In FIG. 19, the listener is seated in swivel chair 3008, and moves himself with his feet (thus changing his listening orientation). Gyroscope 3002, and sound absorption material 3009, 3010 are attached to the chair. The program source and speakers were arranged as follows. The group of dummy heads 3004 were used for the microphone. A multi-channel recording is made with tape machine 3006. The speakers are multi-channel (in this case they were 10 channel). Amp 3005 is controlled by a signal (dotted line 3007) from the gyroscope. The signal sent to the speakers thus alters according to the movement of the chair.

This change is responded to by the dummy head mikes, which move accordingly.

Dummy head mike A is used when the listener is facing front.

At the same time, speakers labeled A are activated. This selection occurs automatically on the basis of the signal 3007.

The labels B through E have the same significance. Reproduction is also when possible when the listener is oriented toward a point between A and E. This is accomplished by use of the devices corresponding to A and E in parallel.

The apparatus in FIG. 20 differs from that in FIG. 19 in the following respects. First, there is one pair of speakers (fixed speakers 3105 and 3106). Instead, there are two reflecting panels, 3107, 3108, that move in tandem with the rotation of the chair. The amplifier is two-channel.

This apparatus operates as follows. The rotation of the chair is detected by the gyroscope 3103 and conveyed via 3104 as an electric signal to the recording device. The output from the recorder is sent to speakers 3105, 3106. The sound from the fixed speakers is reflected by reflecting panels 3107, 3108 toward the listener.

If the sound reflected by the reflecting panels is excellent, satisfactory reproduction can be achieved by this method. Ideally, speakers with good quality sound yet light enough to be affixed in place of the reflecting panels would be preferable.

Figure 21:
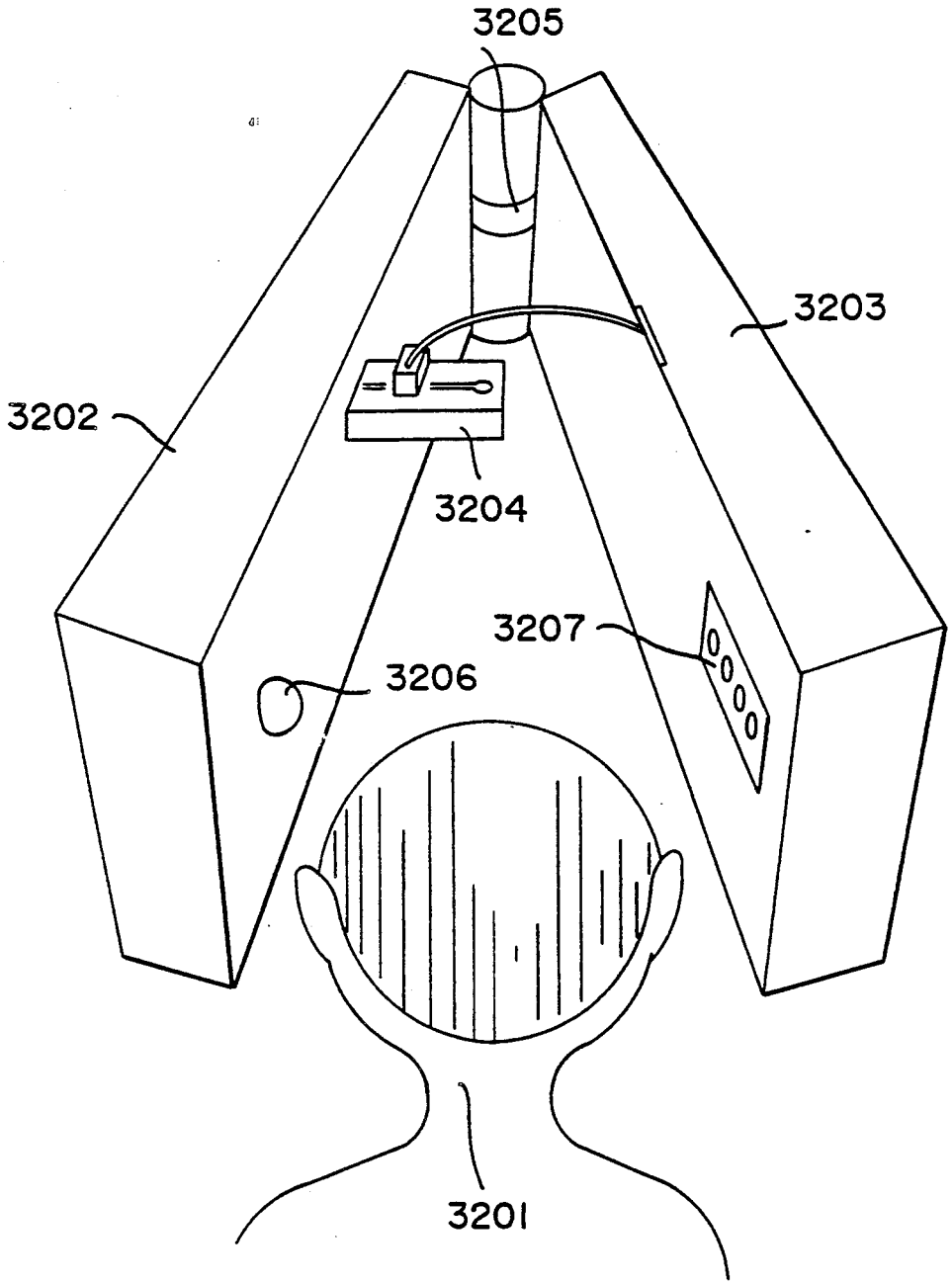
FIG. 21 is a perspective view.

The difference in volume between high-range sounds heard with and without sound absorption devices can be more than 20 decibels. Therefore, it is always necessary for the listener to adjust the volume when putting on and removing the sound absorption device. This constant adjustment is bothersome. To cope with this, FIG. 21 depicts a means of adjusting volume (or sound quality) in accordance with the movements of the listener wearing the device.

Here, three types of sensor for automatically altering the sound level have been attached.

These are; variable resistor 3205, at the hinge of sound absorption panels 3202 and 3203; variable resistor 3204, that slides to adjust the distance between sound absorption panels 3202 and 3203; infrared lamp 3206 and receptor 3207, which function as a light sensor and determine where the listener 3201 is in relation to the sound absorption material.

By means of the information provided by one of these three devices, the volume can be regulated to increase when the listener is using the sound absorption device and decrease when the device is removed. Ideally, the device should be made so that the degree of volume adjustment is itself altered according to the listening conditions.

EFFECTS OF THE INVENTION

This invention offers a variety of advantages, as described in (a) through (h) below.

(a) In this invention, a method is used whereby a sound extinguishing device with adjustable sound extinguishing effect is placed in proximity to the head of the listener.

Consequently, when the extinguishing effect of the device is maximized, the listener experiences a body-oriented sound pressure balance, as if hearing a distance or highly dispersed sound. Conversely, reducing the extinguishing effect of the device will create a more ear-oriented balance of sound pressure, making the sound seem closer. In this way, the balance of sound pressure can be varied freely in accordance with the image of the program source. Further, extraneous normal positions (such phenomena as the shift effect mentioned in the presentation of the problem at the beginning of this application) can be eliminated.

(b) In this invention, distortion occuring in the area of the listener's head is eliminated by sound absorption material 144 (FIG. 7). By this means, biaural normal position information can be heard without masking. In addition, the compromise of sound quality that accompanies speaker reproduction of a biaural source is eliminated. The orientation and shape of the sound as it was in the environment in which it was recorded can be reproduced extremely faithfully and with excellent sound quality.

(c) Since this invention employs sound pressure, its effect is much more natural than that of previous devices like the "Body - sonic", that work by conveying vibrations directly to the body.

(d) This invention is designed so that even if the listener's head is different in size or shape from the dummy-head mike, it retains the reflected sound from the frontal reverberation area 2311 (FIG. 12) so that the important sensation of frontal normal position can be attained.

What is claimed is:

1. A sound reproduction system for a listener comprising: left and right sound sources for propagating sound towards the head and body of the listener, a first sound extinction element positionable in a vicinity of the head of the listener for extinguishing a portion of the sound propagated to the vicinity of the head of the listener, a second sound extinction element positionable in a vicinity of the body of the listener for extinguishing a portion of the sound propagated to the vicinity of the body of the listener, the first sound extinction element further extinguishing a portion of a sound reflected from the head of the listener toward the ears of the listener, and the extinction elements together comprising screening devices for extinguishing sound propagated from the left sound source to the right ear of the listener and from the right sound source to the left ear of the listener, the screening devices being video monitors.

2. A sound reproduction system for a listener comprising: a sound source for propagating sound towards the head and body of the listener, a first sound extinction element positionable in a vicinity of the head of the listener for extinguishing a portion of the sound propagated to the vicinity of the head of the listener, a second sound extinction element positionable in a vicinity of the body of the listener for extinguishing a portion of the sound propagated to the vicinity of the body of the listener, a chair for the listener provided in adjustable combination with said sound extinction elements, and a detection device affixed to the chair capable of detecting a change in the relative position of the chair with respect to the sound extinction elements.

3. A sound reproduction system for a listener comprising: a sound source for propagating sound towards the head and body of the listener, a first sound extinction element positionable in a vicinity of the head of the listener for extinguishing a portion of the sound propagated to the vicinity of the head of the listener, and a second sound extinction element positionable in a vicinity of the body of the listener for extinguishing a portion of the sound propagated to the vicinity of the body of the listener, the first sound extinction element further comprises at least two generally plate-shaped sound extinction members positionable in the vicinity of the head of the listener, said members being hingably connected together into a single substantially "V"-shaped element having an adjustable interior angle, said "V"-shaped element further including a device for detecting a change in the adjustable interior angle of the "V"-shaped element.

4. A sound reproduction system for a listener comprising: a sound source for propagating sound towards the head and body of a listener, a first sound extinction element positionable in a vicinity of the head of the listener for extinguishing a portion of the sound propagated to the vicinity of the head of the listener, and a second sound extinction element positionable in a vicinity of the body of the listener for extinguishing a portion of the sound propagated to the vicinity of the body of the listener, said first sound extinction element being positionable at a distance from the head of the listener, and a detection device to detect a change in the distance between the first sound extinction element and the head of the listener.

5. A sound reproduction system for reproducing sound for a listener, said system comprising:

left and right sound sources each positioned forward to, and laterally outward with respect to, the respective left and right ears of the listener for propagating sound toward the listener, a sound extinction means for defining sound propagation paths between the sound sources and the respective ears of the listener and for preventing the sound propagation of a portion of the sound from the sound source to the face of the listener, said sound extinction means being positioned between vertical planes extending from the ears of the listener to the respective left and right sound sources, wherein said sound extinction means comprises left and right plate shaped members of sound extinguishing material, each plate member being positioned substantially parallel to the respective planes.

6. The sytem of claim 5, wherein said sound sources together comprise a biaural sound source system.

7. A sound reproduction system for reproducing sound for a listener, said system comprising:

left and right sound sources each positioned forward to, and laterally outward with respect to, the respective left and right ears of the listener for propagating sound toward the listener, a sound extinction means for defining sound propagation paths between the sound sources and the respective ears of the listener and for preventing the sound propagation of a portion of the sound from the sound source to the face of the listener, said sound extinction means being positioned between vertical planes extending from the ears of the listener to the respective left and right sound sources, wherein said sound extinction means comprises a single sound absorbing member which is fitted on the head of the listener.

8. The system of claim 7, wherein said sound sources together comprises a biaural sound source system.

* * * * *